US011300389B1

(12) United States Patent
Han

(10) Patent No.: US 11,300,389 B1
(45) Date of Patent: Apr. 12, 2022

(54) SLIP BASEPLATE

(71) Applicant: U.S. Army Combat Capabilities Development Command Armaments Center, Dover, NJ (US)

(72) Inventor: Seungeuk Han, Highland Park, NJ (US)

(73) Assignee: The United States of America as Represented by the Secretary of the Army, Washington, DC (US)

( * ) Notice: Subject to any disclaimer, the term of this patent is extended or adjusted under 35 U.S.C. 154(b) by 0 days.

(21) Appl. No.: 16/357,585

(22) Filed: Mar. 19, 2019

Related U.S. Application Data

(60) Provisional application No. 62/666,895, filed on May 4, 2018.

(51) Int. Cl.
*F42B 10/02* (2006.01)
*F42B 14/02* (2006.01)
*F42B 10/00* (2006.01)

(52) U.S. Cl.
CPC ..... *F42B 10/02* (2013.01); *F42B 14/02* (2013.01)

(58) Field of Classification Search
CPC ..... F42B 10/02; F42B 14/02; F42B 30/003; F42B 10/14; F42B 10/64; F42B 10/54; F42B 10/06; F42B 10/50; F42B 10/62; F42B 10/24; F42B 10/16; F41A 23/54; F41J 9/10; F41G 7/2213; F41G 7/222
See application file for complete search history.

(56) References Cited

U.S. PATENT DOCUMENTS 2,558,024 A * 6/1951 Weiss ..... F41A 23/54 89/37.05
4,193,567 A * 3/1980 McCarty, Jr. ..... F41G 7/222 244/3.16
4,752,052 A * 6/1988 Galvin ..... F42B 10/16 244/3.27
4,815,682 A * 3/1989 Feldmann ..... F42B 10/06 102/521
5,033,388 A * 7/1991 Sippel ..... F42B 30/003 102/357
5,164,538 A * 11/1992 McClain, III ..... F42B 10/24 102/501
5,186,413 A * 2/1993 Deakin ..... F41J 9/10 102/388
5,393,012 A * 2/1995 Dunn ..... F42B 10/54 244/3.21
5,423,497 A * 6/1995 Ransom ..... F42B 10/62 244/3.21
6,116,537 A * 9/2000 Kempas ..... F41G 7/2213 244/3.1
6,126,109 A * 10/2000 Barson ..... F42B 10/54 244/3.28
6,682,014 B1 * 1/2004 Hickey ..... F42B 10/50 244/3.27
6,869,044 B2 * 3/2005 Geswender ..... F42B 10/06 244/3.29

(Continued)

*Primary Examiner* — Bernarr E Gregory
(74) *Attorney, Agent, or Firm* — Michael C. Sachs

(57) ABSTRACT

A rear slip base plate for a round carrying a guidance and control unit payload, which round is launched from a rifled launch tube. To prevent the guidance and control unit payload from also being rapidly spun with the round, the slip base plate unit mechanically isolates the guidance and control unit payload from the round spin rate.

5 Claims, 2 Drawing Sheets

(56) References Cited

U.S. PATENT DOCUMENTS

Figure 1:
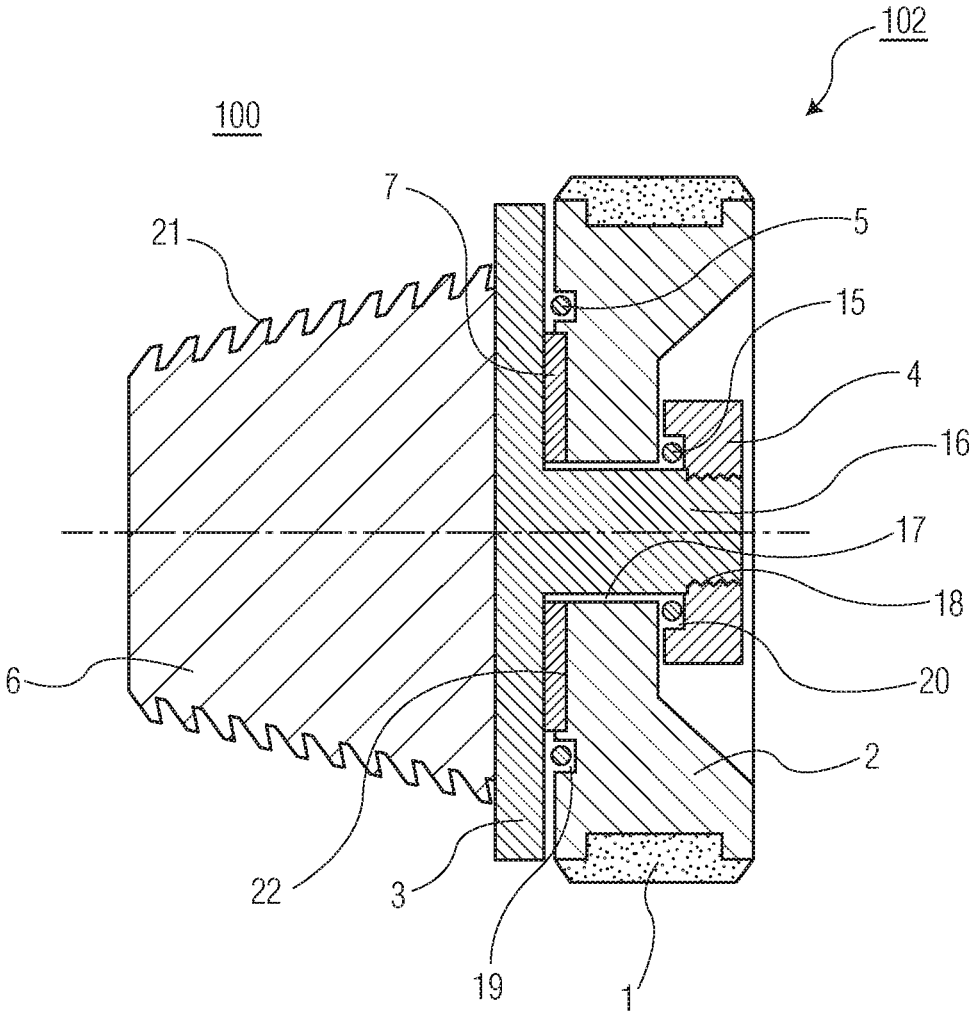

| | | | | |
|---|---|---|---|---|
| 7,354,017 | B2 * | 4/2008 | Morris | F42B 10/54<br>244/3.23 |
| 7,412,930 | B2 * | 8/2008 | Smith | F42B 10/54<br>102/473 |
| 2012/0217338 | A1 * | 8/2012 | Flood | F42B 10/64<br>244/3.1 |
| 2012/0248239 | A1 * | 10/2012 | Geswender | F42B 10/64<br>244/3.23 |
| 2014/0209732 | A1 * | 7/2014 | Pettersson | F42B 10/14<br>244/3.23 |

* cited by examiner

SLIP BASEPLATE

CROSS REFERENCE TO RELATED APPLICATIONS

This application claims benefit under 35USC119 (e) from provisional application 62/666,895 filed May 4, 2018, entitled "Slip Baseplate" by the same inventors herein and commonly assigned, the entire file wrapper contents of which are hereby incorporated by reference as though fully set forth.

U.S. GOVERNMENT INTEREST

The inventions described herein may be made, used, or licensed by or for the U.S. Government for U.S. Government purposes.

BACKGROUND OF INVENTION

Many currently deployed ammunition projectiles are further equipped with their own on board guidance and control systems ("G & C") to further precision steer the projectile in flight, even after launch. Because of the onboard G & C systems these ammunition projectiles must ideally not be spun on their longitudinal axes upon launch, or only negligibly spun, because such spinning later interferes with the operation of the G & C systems, which would still unwantedly spin thereafter during flight. Accordingly, such projectiles ideally might be fin stabilized and launched therefore out of smooth bore only launching tubes, at zero or very low spin rates. Currently however, rifled launching tubes are the norm. With firing out of a rifled gun, a round will have very high spin rate depending on the muzzle velocity and the gun rifling.

In an existing method, the projectile is often equipped with a slip obturator ring to minimize the initial spin rate. But such a slip obturator ring has issues of inconsistency, fragmentation at the gun exit, poor performance, unacceptably high firing signatures, and excessive bypassing gases. Various plastic slip obturator rings may also typically be used, but conventional plastic slip obturator rings often have the same issues; issues are with obturation performance, excessive bypassing gas, inconsistent muzzle velocity and spin rate, fragmenting at the gun exit, and high firing signature.

Because of the above problems, a compromise system is sought where a G & C nose system might still be launched on a projectile from a rifled tube, yet the G & C components will still not spin appreciably after launch.

BRIEF SUMMARY OF INVENTION

In this invention, a slip baseplate is used with a conventional rifling obturator ring to maximize gun pressure, minimize bypassing gas, maximize consistency in muzzle velocity, minimize initial spin rate, and minimize firing signatures.

This invention may specifically be applicable to sabot type launching systems that have a baseplate. An example is shown here in FIG. 2, e.g. This kind of G&C projectile 200 launching system typically would have a variety of obturator rings to minimize the launching spin rate when the G&C carrier 6 is shot out of a rifled gun tube (see also FIG. 1). The invention equips the conventional metal rotating band 1, which still does exactly the same obturation as in any traditional spin stabilized projectile launching from a rifled gun. But, the invention has annular shaped elements comprising ball bearings (5 and 15) in between the two annular shape plates (bolt plate 3 and nut plate 2) to maximize their independency in motion, for independent rotations. In practice, the spin rate of carrier 6 of the projectile (on bolt plate 3) therefore is induced with a much lower rate than the spin rate of the nut plate 2 which has an obturator ring 1 engaging the gun rifling.

OBJECTS OF THE INVENTION

Accordingly, it is an object of the present invention to provide means for isolating the spin rate of a payload carried on a round, from the rapid spin rate of the round upon launch.

Another object of the present invention is to provide a rear slip base plate for a round carrying a guidance and control unit payload, which round is launched from a rifled launch tube.

It is a further object of the present invention to provide means to prevent a guidance and control unit payload from also being rapidly spun up with a round, during launch.

It is yet another object of the present invention to provide a slip base plate unit in a round, which mechanically isolates a guidance and control unit payload from the rapid round spin rate.

These and other objects, features and advantages of the invention will become more apparent in view of the within detailed descriptions of the invention, the claims, and in light of the following drawings and/or tables wherein reference numerals may be reused where appropriate to indicate a correspondence between the referenced items. It should be understood that the sizes and shapes of the different components in the figures may not be in exact proportion and are shown here just for visual clarity and for purposes of explanation. It is also to be understood that the specific embodiments of the present invention that have been described herein are merely illustrative of certain applications of the principles of the present invention. It should further be understood that the geometry, compositions, values, and dimensions of the components described herein can be modified within the scope of the invention and are not generally intended to be exclusive. Numerous other modifications can be made when implementing the invention for a particular environment, without departing from the spirit and scope of the invention.

LIST OF DRAWINGS

FIG. 1 illustrates cross sectionally a carrier assembly 6 attached to a slip base plate assembly 102, wherein rotation of the carrier assembly as a result of launching in a rifled launching tube is greatly lessened by the slip base plate assembly 102 according to this invention.

Figure 2:
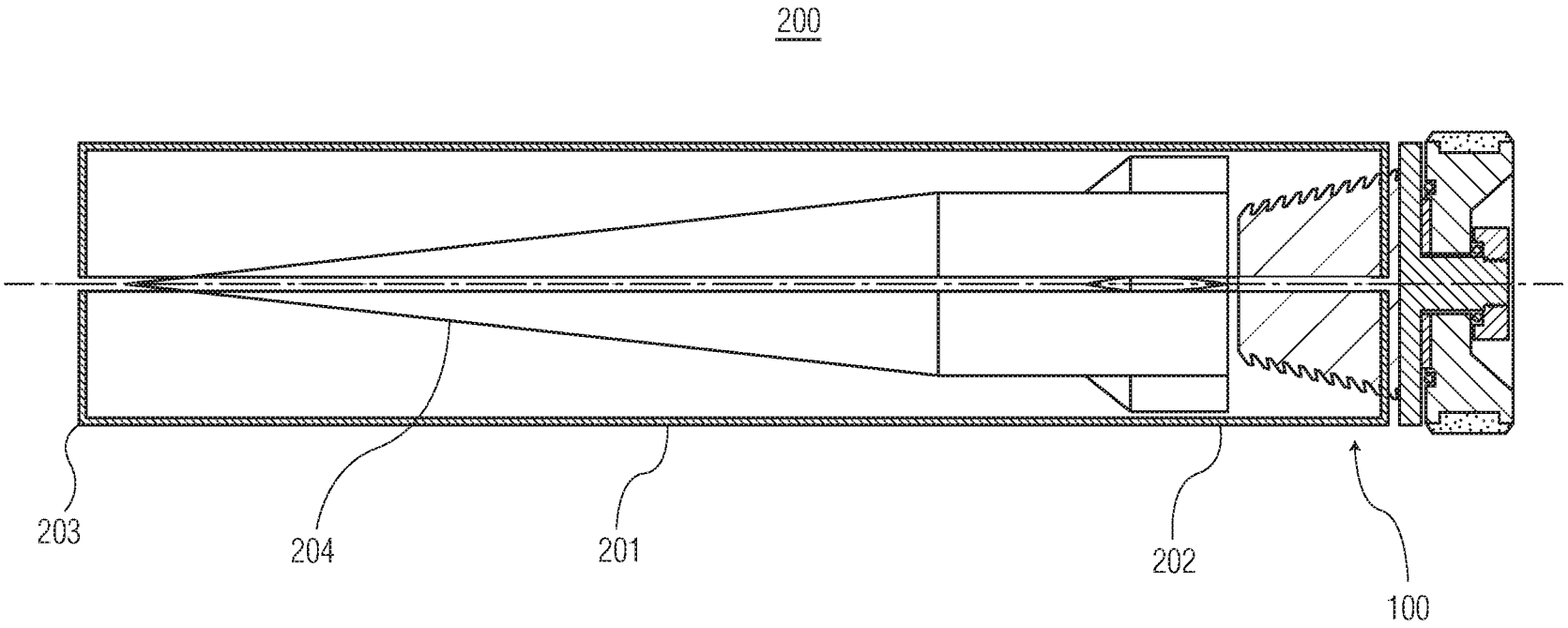

FIG. 2 shows the position of the carrier and slip base plate assembly together noted as assembly 100, within a launching round 200, according to this invention.

DETAILED DESCRIPTION

FIGS. 1 and 2 show a round 200 for launching a carrier 6 which holds a guidance and control system, a problem being addressed here that the guidance and control system would be degraded by rotational motion. But, the round launches as being rapidly rotated while forwardly launched through a typical rifled launching tube. Carrier housing 6, which has outer facing vanes 21 thereon, is here located together with a device to overcome the stated problem, being by employing a rear slip baseplate unit 102. Altogether, the whole of FIG. 1 together comprises an assembly 100 in the round 200. Saboted carrier housing 6 has a bolt plate 3 attached rearwardly behind the carrier housing, and the bolt plate also has thereon a rearward facing stem 16 and upon which stem are threads 18. The rear slip baseplate unit 102 comprises a rotating band 1 on a nut plate 2; there is also a hole 17 in the nut plate in which the stem is free to rotate. There is a threaded nut 4 which is sized to engage the stem threads, and the nut attaches the nut plate to the bolt plate. There is a first ball bearing means 15 (which may be annularly configured) in an indented space 20 located between the nut and nut plate, the indented space 20 is sized to mate to first ball bearing means 15. The first ball bearing means 15 may comprise a bearing pad or other type of bearing means.

There further also is a second ball bearing means 5 (which may be annularly configured) in the nut plate located in an indented space 19. The indented space 19 is sized to mate with the second ball bearing means 5. The second ball bearing means 5 may comprise a bearing pad or other type of bearing means. There is a friction pad means 7 (which may be annularly configured) as may be desired to increase frictional contact for certain select applications, which may be located in part in indented space 22 in the nut plate, positioned between the nut plate and the bolt plate, (The indented space 22 is sized to mate with the friction pad means 7). A bearing and friction pad composite component may be selected for use instead, here.

As a consequence, carrier 6 and bolt plate 3 experience reduced rotational spin than do nut plate 2 and rotating band 1, during launching of assembly 100 by the round. Such is as a result of friction pad 7 action changing/and ball bearings 5, 15 actions reducing, rotational spin of the carrier 6 and bolt plate 3. The friction pad means (which may be annularly configured) is located at/around the stem, and between the nut plate and the bolt plate, to provide a measure of friction as may be desired between relative movements of the bolt plate with respect to the nut plate. The second ball bearing means 5 (which may be annularly configured) is located at/around the stem and between the nut plate and the bolt plate. The first ball bearing means 15 (which may be annularly configured) is located at/around the stem and between the threaded nut and the nut plate, to provide free relative movements of bolt plate and stem with respect to the threaded nut. The round 200 has a nose 204, an enclosing case 201 with a front 203 thereon, and a rear line of location 202 to where assembly 100 is connected. During flight, assembly 100 is separated; the remainder of launching round 200 peels and falls away, through mechanisms not shown herein.

While the invention may have been described with reference to certain embodiments, numerous changes, alterations and modifications to the described embodiments are possible without departing from the spirit and scope of the invention as defined in the appended claims, and equivalents thereof.

What is claimed:

1. In a round (200) for launching a guidance and control system which is degraded by rotational motion, said guidance and control system being located within a forward saboted carrier housing (6) which has outer facing vanes (21) thereon and wherein said round experiences rotation while forwardly launched through a rifled launching tube, said saboted carrier housing (6) being located together with a rear slip baseplate unit (102) as an assembly (100) in said round, and wherein said saboted carrier housing has a bolt plate (3) attached rearwardly behind said carrier housing, and said bolt plate also has thereon a rearward facing stem (16) and upon which stem are threads (18), and which rear slip baseplate unit (102) further comprises a rotating band (1) on a nut plate (2) and also a hole (17) in said nut plate in which said stem is free to rotate, and a threaded nut means (4), which is sized to engage the stem threads (18) and which nut attaches said nut plate to said bolt plate, and there further being a first ball bearing means (15) located between said nut and said nut plate, and; there further also being a second ball bearing means (5) and a friction pad means (7), both located between said nut plate and said bolt plate, whereupon carrier (6) and bolt plate (3) experience reduced rotational spin than do the nut plate (2) and rotating band (1) during launching of assembly (100) in said round as a result of ball bearing (5, 15) actions reducing rotational spin of said carrier (6) and said bolt plate (3).

2. The round of claim 1 wherein said first ball bearing means (15) is located in an indented space (20) located annularly around said stem, inside said threaded nut means (4) facing the bolt plate (3), and said indented space (20) is sized to mate with said first ball bearing means (15), which is annular configured, and located between said threaded nut means and said bolt plate to provide free relative movements of the nut plate with respect to said stem and bolt plate.

3. The round of claim 1 wherein said second ball bearing means (5) is annularly configured and located around said stem and between said nut plate (2) and said bolt plate (3), and in an indented space (10) located in said nut plate and which is sized to mate with said second ball bearing means (5), to provide free relative movements of bolt plate and stem with respect to said nut plate.

4. The round of claim 1 wherein said friction pad means (7) is annularly configured and located in an indented space (22) in said nut plate (2) and being also positioned around said stem, and which indented space (22) is sized to mate with said friction pad means (7), and which friction pad means (7) is also located between said nut plate and said bolt plate, to provide a measure of friction between relative movements of the bolt plate with respect to said nut plate.

5. The round of claim 1 wherein said round (200) has a nose (204), an enclosing case (201) with a front (203) thereon, and a rear location (202) to where assembly (100) is connected.

* * * * *